United States Patent [19]

DuLondel

[11] 4,173,332

[45] Nov. 6, 1979

[54] ROTARY SPEED LIMITER DEVICE

[76] Inventor: Jacques DuLondel, 264, av. Querbes, Outremont, Québec, Canada, H2V 3W2

[21] Appl. No.: 839,734

[22] Filed: Oct. 5, 1977

[30] Foreign Application Priority Data

Nov. 3, 1976 [CA] Canada ..... 264816

[51] Int. Cl.[2] ..... A62B 1/12

[52] U.S. Cl. ..... 254/160; 182/5; 188/316; 188/322; 254/157

[58] Field of Search ..... 254/151, 154, 155, 157, 254/158, 159, 160; 182/5, 75; 188/65.1, 290, 311, 316, 322

[56] References Cited

U.S. PATENT DOCUMENTS

| | | | |
|---|---|---|---|
| 1,993,074 | 3/1935 | Payson | 254/155 |
| 3,211,396 | 10/1965 | McQuillen | 188/290 X |
| 3,595,528 | 7/1971 | Virkki | 254/158 X |
| 3,628,638 | 12/1971 | Curchack | 188/316 X |
| 3,879,016 | 4/1975 | Kankkunen | 254/160 X |
| 4,003,550 | 1/1977 | Brodin | 254/151 |

*Primary Examiner*—Trygve M. Blix
*Assistant Examiner*—Winston H. Douglas

[57] ABSTRACT

A rotary speed limiter device particularly useful as a fire escape device. The device has a rotary speed limiter member mounted on a shaft to slide axially on the shaft and to rotate with it. Means, the speed of which is to be controlled, rotates the shaft. As the shaft is rotated, means applies a braking force on the speed limiter member, causing it to compress air in a surrounding support body and to move axially on the shaft, to limit the speed of the shaft rotating means.

1 Claim, 8 Drawing Figures

ROTARY SPEED LIMITER DEVICE

This invention is directed toward a mechanical rotary speed limiter device, and more particularly, to such a device employed as a fire escape device.

Fire escape devices employing a cable, which a person holds to descent from a building, are known. These devices, however, have a rather complicated construction in order to limit the rate of descent of the person, which rate can vary depending on the weight of the person employing the device.

It is therefore a particular purpose of the present invention to provide an improved fire escape device, of the cable type, which limits the rate of descent of a person using the device, in a relatively simple yet reliable manner.

It is a more general purpose of the present invention to provide a simple, yet reliable, mechanical device for automatically limiting the speed of a rotating member.

The device of the present invention automatically provides a braking force on a rotating member which is a function of the speed of rotation of the member. The device employs a minimum number of moving parts to apply the desired braking force.

In accordance with the present invention, the device broadly comprises a shaft and means for rotating the shaft. One or more speed limiter members are mounted on the shaft to move axially along the shaft and to rotate with the shaft. Means automatically apply a braking force to the speed limiter member when the shaft rotates, causing this member to move axially on the rotating shaft, to limit the speed of the rotating means.

More particularly in accordance with the present invention, when employed as an escape device, the rotary speed limiting device comprises a support body with a shaft rotatably mounted on the support body. Movable escape means are provided for rotating the shaft. A speed limiter member is mounted on the shaft to slide axially on the shaft and to rotate with the shaft. Means automatically applies a braking force to the speed limiter member when the escape means rotates the shaft, causing this member to move axially on the rotating shaft and to limit the speed of the escape means.

The braking force applying means comprises a sinuous camming groove on one of the support body and the speed limiter member, the groove encircling the shaft; and at least one camming pin on the other of the support body and the speed limiter member extending into the groove.

The invention will now be described in detail having reference to the accompanying drawings, wherein.

Figure 6:
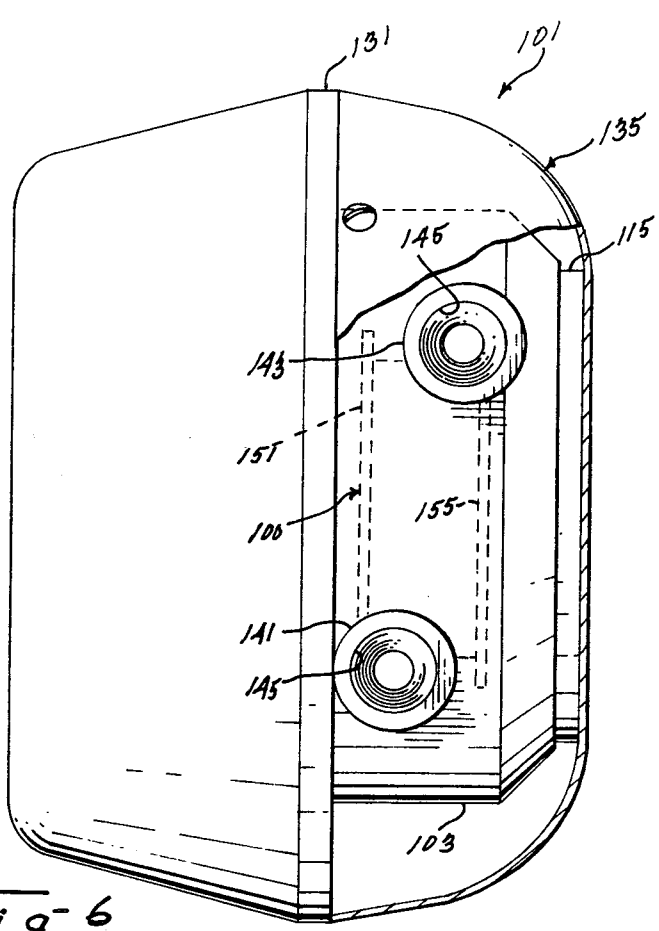
Figure 3:
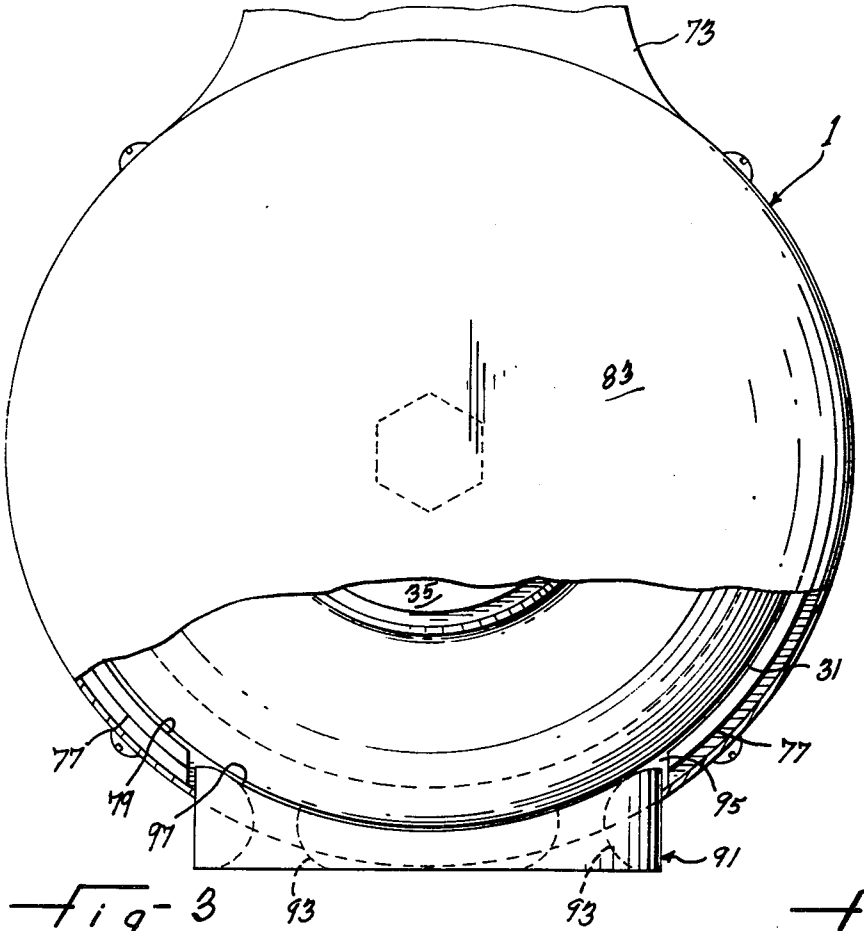
FIG. 3 is an elevation view, in partial section, of the device.
Figure 4:
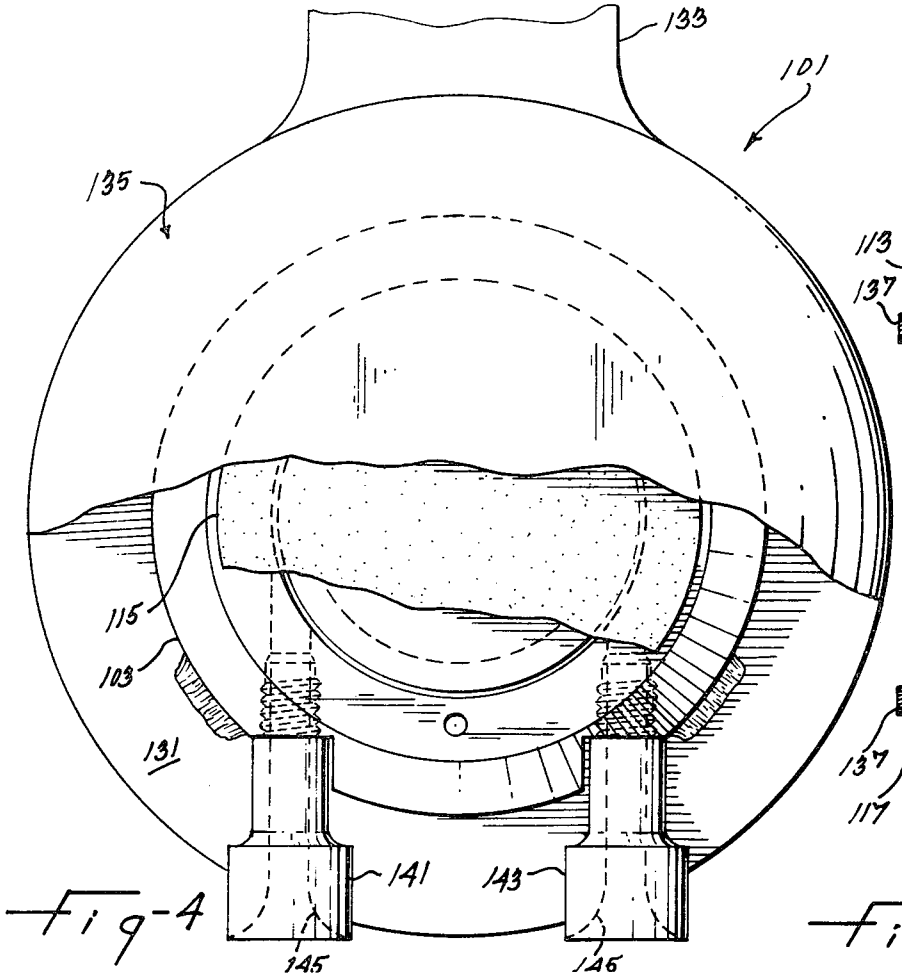
FIG. 4 is an elevation view, in partial section, of a modified version of the escape device.
Figures 7, 8:
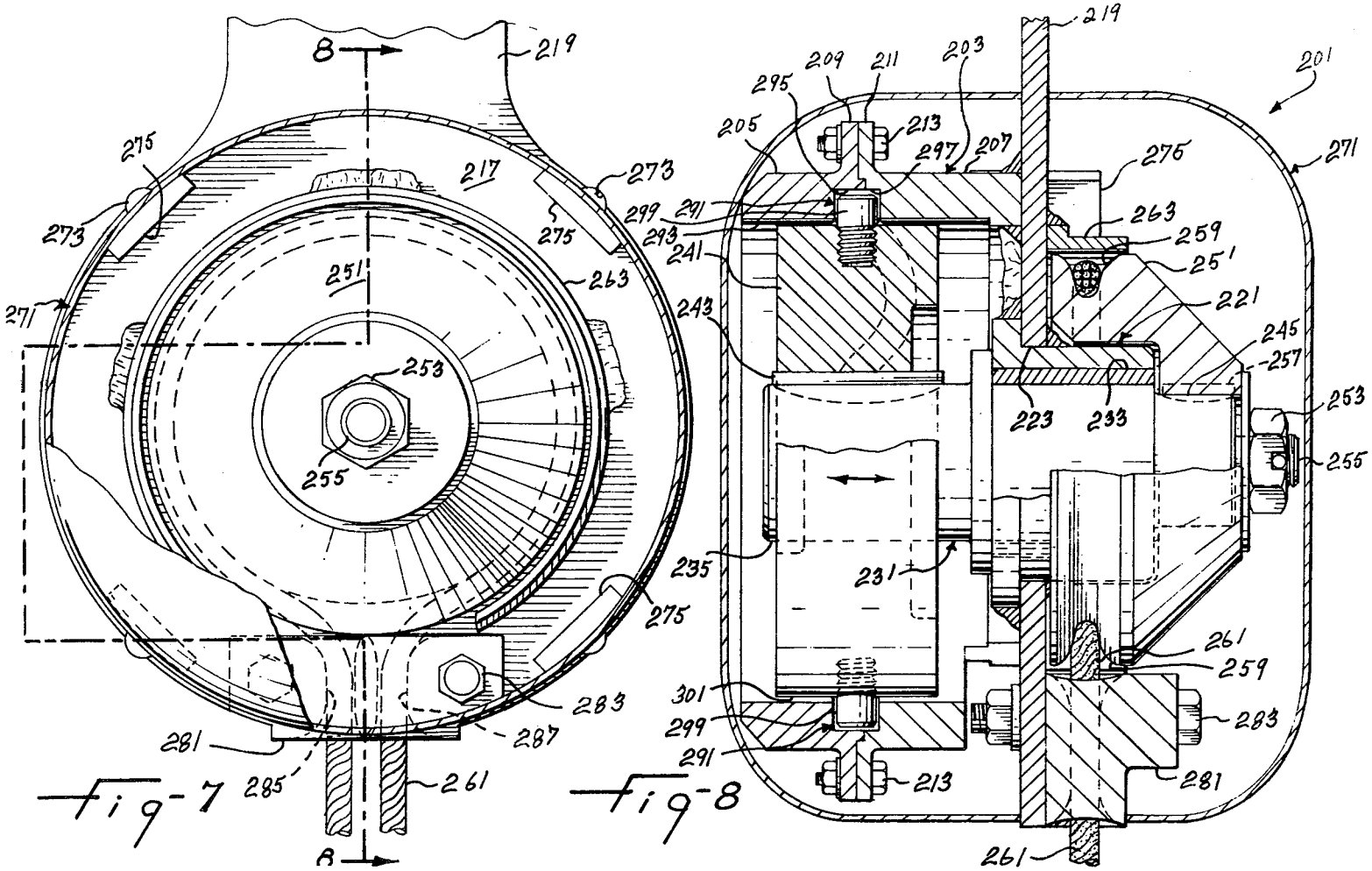

FIG. 6, appearing on the same sheet as FIG. 3, is a bottom view, in partial section, of the device shown in FIG. 4;

FIG. 7 is an elevation view, in partial section, of yet another version of the escape device; and FIG. 8 is a cross-section view, taken along line 8—8 of FIG. 7.

Figure 2:
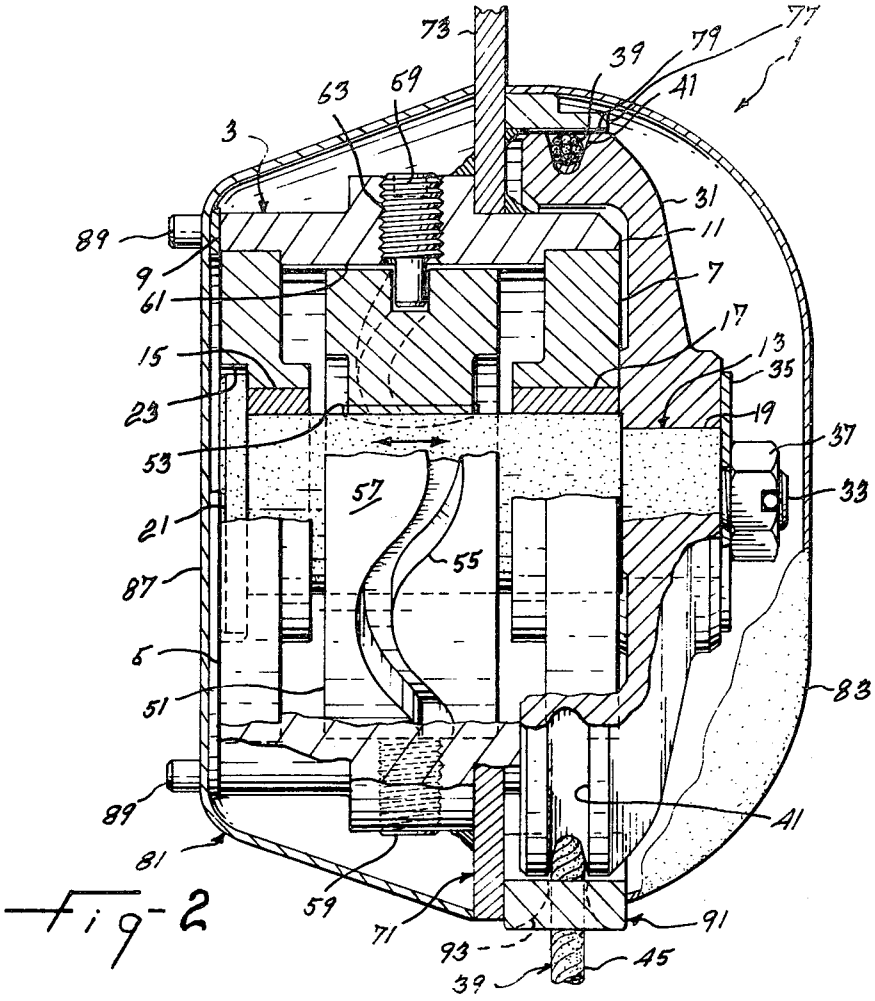
FIG. 2 is a cross-section view of the same device taken along line 2—2 of FIG. 1.
Figure 1:
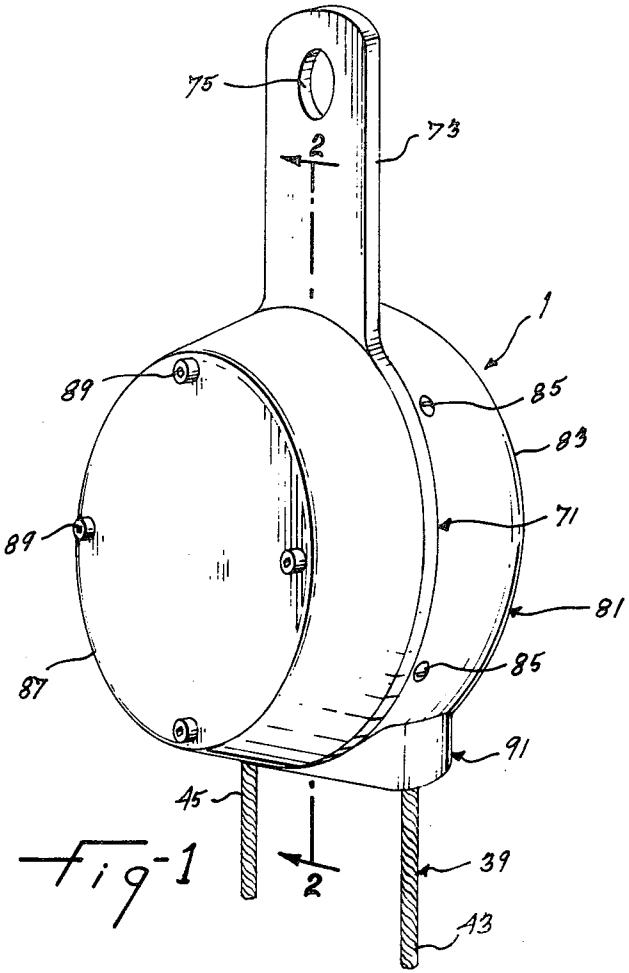
FIG. 1 is a perspective view of an escape speed limiter device according to a first embodiment of the present invention.

The escape speed limiter device 1 of the present invention, as shown in FIGS. 1 to 3, has a main, generally cylindrical, support body 3. A pair of circular end plates 5,7 close the ends 9,11 of support body 3. A cylindrical shaft 13 is rotatably mounted in bushings 15, 17 fixed in end plates 5, 7 respectively. The shaft 13 is in the center of cylindrical body 3. A stepped-down portion 19 of the shaft 13 projects past end plate 7 out of body 3. The other end of the shaft 13 has an enlarged portion 21 which concentrically sits it an enlarged bore hole 23 formed in the outer face of end plate 5.

A pulley 31 is fixedly mounted on the stepped-down portion 19 of shaft 13. The shaft portion 19 can have a threaded stud 33 projecting axially therefrom. A washer 35, and a nut 37, threaded on stud 33, retain the pulley 31 on shaft portion 19. A cable, or rope 39, rides in the groove 41 of pulley 31. The cable 39 is formed in a long closed loop having two runs 43, 45 extending down from the device 1.

A cylindrical rotation speed limiter member 51 is mounted on shaft 13 between end plates 5, 7. The member 51 is narrower than the distance between end plates 5, 7 and has an outer diameter slightly less than the inner diameter of support body 3 to form a limited cylindrical air gap with the latter. A key 53 fixes the member 51 to rotate with shaft 13. The member 51 is axially movable along shaft 13, and key 53, between plates 5, 7. A continuous, sinuous, camming groove 55 is provided in the outer cylindrical surface 57 of member 51. At least one, and preferably two diametrically opposed camming pins 59, project from the inner cylindrical surface 61 of body 3 into groove 5. The pins 59 are threaded into through holes 63 in body 3.

A hanger ring 71, having an upwardly projecting hanger strap 73 with a hole 75 in the strap, is concentrically mounted about body 3 and fixed thereto. A keeper ring 77 is attached to one side of hanger ring 71. The keeper ring 77 is concentric about pulley 31 and its inner surface 79 closely overlies groove 41 on pulley 31 to retain cable 39 within groove 41.

A casing 81 encloses the operating parts of device 1. The casing 81 can comprise two sections. One section 83 covers the operating parts on one side of hanger ring 71 and is fixed by bolts 85 to keeper ring 77. The other section 87 covers the operating parts on the other side of hanger ring 71 and is fixed by bolts 89 to main body 3. The casing section 83 has a cable guide fixture 91 attached to it. This fixture 91, at the bottom of casing section 83, has two spaced-apart openings 93, as shown in FIG. 3, serving as an inlet and an outlet for the runs 43, 45 of looped cable 39. The openings 93 are rounded and aligned with groove 41 in pulley 31. A portion of keeper ring 77 is removed, leaving a gap 95 to accommodate fixture 91, with the inner surface 97 of fixture 91 forming an extension of the inner surface 79 of ring 77.

In operation, in an emergency, the escape device 1 is suspended by its hanger strap 73, from a suitable support outside a building adjacent the building wall. The cable 39 extends down toward the ground as a closed loop. A person in the building grasps one run of the looped cable 39 and supports his weight on it. His weight causes the cable 39 to lower him with the cable 39 rotating pulley 31 and, thus, shaft 13. As shaft 13 rotates, it rotates speed limiter member 51 relative to fixed camming pins 59. The camming pins 59, riding in sinuous groove 55, causes the rotating member 51 to move to and from axially along shaft 13 upon rotation with the latter.

The afore-mentioned limited air gap between the rotary speed control member 51 and the cylindrical support body 3 is such that the axial displacement of the member 51 on the shaft 13 compresses the air between one axial side of this speed limiter member and the corresponding end plate 5 or 7. The pressure thus increases against this one axial side in relation to the speed of axial displacement, and therefore of rotation, of the speed limiter member. Thus, this increased air pressure opposes the axial displacement of the speed limiter member 51 and produces proportional pressure and braking engagement of the pins 59 against one face of the groove 55. The compressed air, nevertheless, escapes, through the afore-mentioned cylindrical air gap toward the other axial side of the speed limiter member.

It must be noted that the cylindrical air gap may be dispensed with and replaced by any appropriate means to allow but slow passage of compressed air from one axial side to the other of the speed limiter member 51. This could be done, for instance, by a predetermined seal between the member 51 and the support body 3 and/or with restricted orifices.

Due to the sinuous character of the groove 55, the speed limiter member eventually reverses its axial displacement, thus producing a vacuum against this one axial side thereof and pressure against the other axial side. This, in turn, produces a proportional pressure and braking engagement of the pins 59 against the other face of the groove 55. It will be readily understood that the braking action thus produced is proportional to the speed of rotation of the member 51 and shaft 13 and thus imposes a limiter linear speed to the cable 39.

The speed limiter member 51 has some weight and operates as a counterweight. The torque applied by the cable 39 to the shaft 13 and to the counterweight-like member 51 produces the rotation of the latter at an accelerated axial speed. The acceleration then decreases in proportion to this torque. The counterweight-like member 51 thus gains kinetic energy during its acceleration at a rate proportional to the square of the axial speed which varies in relation with the torque applied. Thus, this axial speed varies in proportion to the square root of a torque relative to another. When the axial speed has fully decelerated, the member 51 starts axial displacement in opposite direction and the cycle repeats itself.

This kinetic energy and the braking pressure on the pins 59 produce the desired braking action to limit the rate of descent of the person supporting itself on the one run of the cable.

In a slightly different embodiment of the invention, the escape device can employ a reel to hold a cable instead of the pulley. The cable can be wound several turns on a reel, thus providing better traction and minimizing slipping that may occur when using a pulley. To minimize slipping when using a pulley, the pulley must be fairly large in diameter. This increases the size of the device. The use of a reel permits the size of the device to be reduced.

Figure 5:
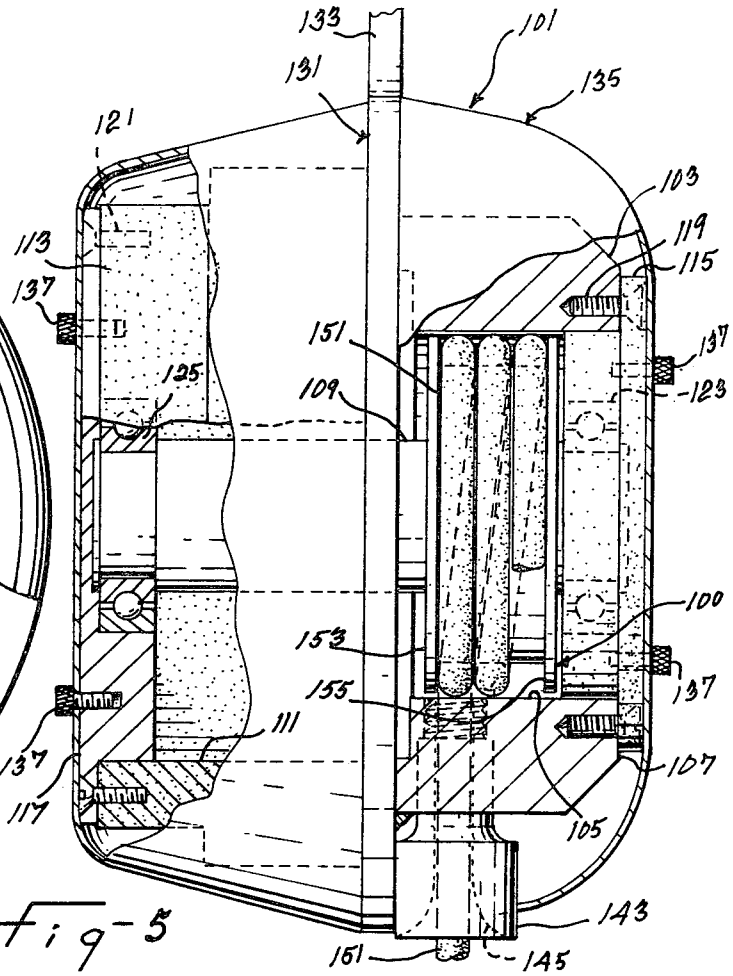
FIG. 5 is another elevation view, in partial section, of the device shown in FIG. 4.

When using a reel 100, the device 1, shown in FIGS. 1 to 3, is slightly modified. As shown in FIGS. 4 to 6, the modified device 101 employs a lengthened support body 103 and has a bore 105 extending in from one end 107 of the body in which reel 100 is fixedly mounted on one end of a shaft 109.

It must be noted that the drum 100 and the bore 105 are of diameters to cooperatively define an annular space of predetermined thickness between them, such that only a single thickness or layer of cable may be wound on the drum. This avoids problems when the cable catching and jamming in the device.

The bore 105 has an enlargement 111 extending to the other end 113 of body 103 in which the cylindrical speed limiter member (not shown) is positioned. The ends 107, 113 of body 103 are closed by end plates 115, 117 respectively attached to body 103 by screws 119, 121 respectively. The shaft 109 is rotatably mounted in end plates 115, 117 by roller bearings 123, 125 respectively. The device 101 has a hanger ring 131, as before, fixed to body 103 and with a hanger strap 133 extending up therefrom. A two-piece casing 135 encloses the operating parts, attached to the end plates 115, 117 by bolts 137. A pair of cable guides 141, 143 are attached to body 103. The guides 141, 143 extend up through casing 135 and are threaded into body 103. Each guide 141, 143 has an enlarged mouth 145 defining cable guide passages through which cable 151 passes. Each of these cable passages constitutes an inlet-outlet, since the cable 151 operates in both directions. One guide 141 is positioned near one end 153 of reel 100 and on one side of shaft 109. The cable 151 runs tangentially to reel 100, adjacent end 153 from guide 141. The other guide 143 is positioned near the other end 155 of reel 100 and on the other side of shaft 109. The cable 151 runs tangentially to reel 100, adjacent end 155 from guide 143. This arrangement permits the turns of the cable to be evenly wound about and maintained on reel 100 during use of the device. The speed limiter member, as in the embodiment shown in FIGS. 1 to 3, has a sinuous camming groove, and camming pins on the body 103 ride in the groove to apply a braking action to the rate of movement of the cable during use.

The embodiment of the device 201, shown in FIGS. 7 and 8, is similar to that shown in FIGS. 1 to 3. In this embodiment, the main cylindrical support body 203 comprises two cylindrical portions 205, 207 having rims 209, 211 respectively, by way of which they are bolted together with bolts 213. The body 203 is fixed at one end 215 to the hanger ring 217 which has an upwardly projecting hanger strap 219.

A second, smaller, cylindrical support body 221 is mounted through a central hole 223 in ring 217 to project from the other side of ring 217 opposite to larger main body 203. The second body 221 is fixed to ring 217. A shaft 231 is rotatably mounted with a bushing 233 in second body 221. A shaft 231 projects from both ends of body 221. One projecting end portion 235 of shaft 231 is concentric within main body 203 and mounts speed limiter member 241. This speed limiter member 241, as in the other embodiments, is free to move axially along shaft 231, but is locked to the shaft with a key 243, so as to rotate with it. The other projecting end portion 245 of shaft 231 has a pulley 251 fixedly mounted thereon. A nut 253, threaded on a stub shaft 255 projecting from shaft 231, locks the pulley 251 to the shaft. The pulley 251 is rotatably locked to shaft 231 with a key 257 and has an outer circular groove 259 in which the cable 261 runs. A keeper ring 263, fixed to hanger ring 217, closely overlies groove 259 to retain the cable in the groove.

A two-part casing 271 covers the operating parts of the device. The casing 271 can be attached with screws 273 to mounting brackets 275, fixed to, and spaced, about both sides of ring 271.

A cable guide 281 is fastened to the bottom of ring 217 with bolts 283. The cable guide 281 has two closely adjacent guide holes 285, 287 forming cable guide passages each for guiding the cable 261 to and from pulley 251. The ends of the holes 285, 287 are smoothly rounded to easily pass the cable. Having the holes 285, 287 closely spaced, provides a greater cable wrap about pulley 251 and thus reduces cable slippage on pulley 251.

In this embodiment, the sinuous groove 291 is provided in the inner surface 293 of the main body 203. One part 295 of groove 291 is formed in portion 205 of body 203, and the other part 297 of groove 291 is formed in portion 207 of body 203. The camming pins 299 project from the outer surface 301 of member 241 into groove 291. As before, rotation of pulley 251 during use of cable 261, causes rotation of member 241. The pins 299, moving in sinuous groove 291, act as a brake to limit the speed of cable movement. With body 203 formed in two parts, and a portion of groove 291 in each part, the device can be readily assembled with pins 299 in groove 291.

The sinuous groove, in all embodiments, along with the size of the parts, and the number of camming pins, are designed to provide an adequate braking action to give the desired rotation speed limit to the cable when used as an escape device. The device should provide adequate speed control, whether used by heavy adults or light children.

The braking effect exerted on the speed limiter member is caused by the pressure exerted by the latter on the camming pins due to its constant acceleration and deceleration in an axial direction during rotation, and to air pressure variations due to motion of axially moving part in the housing.

While the mechanism has been described for use as an escape device, it can obviously be used in other ways where rotation speed limit of a rotating part is desired.

What I claim is:

1. A device for lowering a load while limiting its speed of descent, comprising a casing, means for securing said casing to a stationary support, a shaft rotatable in said casing, a pulley secured to one end of said shaft, a cable trained on said pulley and adapted to support a load for lowering the same, the pull exerted by said cable on said pulley casing rotation of said shaft, a rotor mounted on said shaft, means constraining said rotor to rotate with said shaft while allowing reciprocating movement of said rotor axially of said shaft, said casing defining a cylindrical chamber in which said rotor can rotate and reciprocate axially of said shaft, said chamber having a cylindrical surface closely spaced from the periphery of said rotor, said cylindrical surface and the periphery of said rotor having a continuous, sinuous camming groove encircling said shaft, and a radial complementary pin engaging said camming groove, respectively, whereby said pin causes reciprocating axial movement of said rotor on said shaft during rotation of said rotor by said shaft, resulting in a braking force applied to said shaft, and wherein said chamber forms a closed enclosure filled with air, whereby said rotor forms a piston compressing the air ahead of the axially moving piston, the compressed air retarding axial movement of said piston and consequently increasing the braking force applied to said shaft.

* * * * *